US005655254A

United States Patent [19]

Bores et al.

[11] Patent Number: 5,655,254

[45] Date of Patent: Aug. 12, 1997

[54] CLEANING MACHINE INCLUDING REMOVABLE RECOVERY TANK

[75] Inventors: Frederick M. Bores, Highlands Ranch; Eugene L. Bothun, Loveland, both of Colo.

[73] Assignee: Windsor Industries, Inc., Englewood, Colo.

[21] Appl. No.: 430,823

[22] Filed: Apr. 28, 1995

[51] Int. Cl.[6] ..... A47L 7/00

[52] U.S. Cl. ..... 15/320; 15/331; 15/353

[58] Field of Search ..... 15/320, 321, 353, 15/331, 334

[56] References Cited

U.S. PATENT DOCUMENTS

| | | | |
|---|---|---|---|
| 2,046,658 | 7/1936 | Smellie . | |
| 3,148,400 | 9/1964 | Worwag | 15/327 |
| 4,151,627 | 5/1979 | Wisdom | 15/321 |
| 4,250,592 | 2/1981 | Emrick | 15/320 |
| 4,314,385 | 2/1982 | Wimsatt et al. | 15/321 |
| 4,367,565 | 1/1983 | Parise | 15/321 |
| 4,443,910 | 4/1984 | Fitzwater | 15/337 |
| 4,723,338 | 2/1988 | Otsubo | 15/331 |
| 4,809,397 | 3/1989 | Jacobs et al. | 15/320 |
| 4,934,017 | 6/1990 | Kent | 15/328 X |
| 5,063,633 | 11/1991 | Ingermann et al. | 15/320 |
| 5,210,902 | 5/1993 | Lee et al. | 15/321 |
| 5,319,828 | 6/1994 | Waldhauser et al. | 15/320 |
| 5,343,592 | 9/1994 | Parise | 15/353 |
| 5,386,613 | 2/1995 | Woo | 15/321 X |
| 5,473,792 | 12/1995 | Kent et al. | 15/320 |
| 5,477,578 | 12/1995 | Duncan et al. | 15/320 X |
| 5,500,977 | 3/1996 | McAlise et al. | 15/328 X |

*Primary Examiner*—Chris K. Moore
*Attorney, Agent, or Firm*—Sheridan Ross P.C.

[57] ABSTRACT

A cleaning machine is provided with a recovery tank for containing recovered liquid from a floor or other surface that is being cleaned. The recovery tank has a chamber that houses the recovered liquid and within the chamber are a recovery inlet and a vacuum conduit. The recovery inlet carries the recovered fluid for discharge into the chamber and the vacuum conduit is used in creating a desired vacuum to cause the recovered liquid to be drawn into the chamber. The recovery tank is disposed on a cleaning tank for containing a liquid cleaning solution that is applied to the surface for cleaning purposes. The recovery tank covers an access opening in the cleaning tank for receipt of the liquid cleaning solution. A vacuum motor produces the vacuum and is located next to the cleaning tank below the recovery tank. Sealing members insure a proper seal at the junctions for the recovered liquid and the vacuum when the removable tank is joined to the cleaning tank.

9 Claims, 5 Drawing Sheets

CLEANING MACHINE INCLUDING REMOVABLE RECOVERY TANK

FIELD OF THE INVENTION

The present invention relates to a cleaning machine and, in particular, to a cleaning machine in which a recovery tank for containing liquid recovered from a floor or other surface that is being cleaned can be removed from the machine.

BACKGROUND OF THE INVENTION

Floor cleaning machines include those that controllably dispense a liquid cleaning solution onto the floor for use in cleaning the floor. Subsequent to its use as part of the cleaning operation, liquid on the floor is recovered by the cleaning machine. The recovered fluid is typically housed in a recovery tank of the cleaning machine. After a certain or desired volume of recovered liquid is received, the recovery tank is emptied of the recovered liquid. With regard to such removal of the recovered liquid, it is commonplace to remove the entire cleaning machine to a location where the recovered liquid can be removed. In some cleaning machines, in emptying the recovered liquid, the recovery tank can be separated from the remaining parts of the cleaning machine and the recovered liquid can be dumped from the recovery tank as it is tipped or turned over. In one type of embodiment that has a removable tank, there are exterior hoses that communicate with the tank that must be detached from the tank before its removal. These exterior hoses include a hose for carrying the recovered liquid to the recovery tank and a vacuum hose used in creating a vacuum for drawing recovered liquid into the recovery tank. In another embodiment, conduits for recovered fluid and a vacuum are separate parts and joined to the side of the recovery tank and are removable therewith.

These prior art types of cleaning machines with removable tanks have certain drawbacks. In that regard, it would be advantageous to provide a cleaning machine with a removable tank in which the number of parts is reduced, the manufacture of the recovery tank is facilitated, while being easily removed from the cleaning machine and also being readily attached to the cleaning machine after the recovered fluid has been emptied from the recovery tank without detachment/attachment of external hoses, and at the same time achieving an aesthetically pleasing appearance.

SUMMARY OF THE INVENTION

In accordance with the present invention, a cleaning machine is provided that has a recovery tank for receiving recovered fluid and in which the recovery tank is removable from the remaining parts of the machine without having to disconnect exterior hoses or other connectors. The recovery tank has front, back, bottom and first and second side walls. A chamber is defined within these walls for holding the recovered liquid. A vacuum conduit is formed inwardly of these walls and extends into the chamber. The vacuum conduit is used in drawing recovered liquid into the recovery tank. A recovery inlet is also formed as part of the recovery tank and is located inwardly of the recovery tank walls. The recovery inlet extends upwardly into the recovery tank and carries the recovered liquid for emptying into the chamber of the recovery tank. In a preferred embodiment, the vacuum conduit and recovery inlet are disposed at least a predetermined distance from the recovery tank walls, which predetermined distance is a function of the thickness of the recovery tank walls.

The recovery tank is preferably supported on a cleaning tank for containing a liquid cleaning solution that is useful in cleaning the floor surface. The cleaning tank has an opening for receiving the cleaning solution. The opening is exposed when the recovery tank is removed, while being substantially closed and hidden when the recovery tank is supported on the cleaning tank. A vacuum motor is contained in a liquid-proof casing next to the cleaning tank and beneath the recovery tank. A vacuum member is operatively connected to the vacuum motor and extends into the recovery tank in order to communicate with the vacuum conduit. When the vacuum motor is operating, a vacuum is created in the recovery tank chamber by means of its communication with the vacuum conduit. The vacuum member preferably has a protective cover or cap.

With regard to the attachment of the recovery tank to the cleaning tank, a recovery seal member is positioned about the recovery inlet. The recovery inlet has a groove for receiving portions of the recovery seal member. When the recovery tank is positioned so that the recovery inlet communicates with a recovery tube provided on the cleaning tank, the recovery seal member is compressed by the weight of the recovery tank to provide a desired seal that prevents liquid from leaking at this juncture. Consequently, all of the recovered liquid passes from the recovery tube into the recovery inlet and exits the free end of the recovery inlet into the chamber of the recovery tank. Similarly, the vacuum member has a groove about which a vacuum sealing member is disposed. When the recovery tank is supported on the cleaning tank, the vacuum sealing member is compressed in order to provide an effective seal. This seal insures that a desired vacuum is created in the chamber and avoids any unwanted leakage of any liquid past the vacuum sealing member into the vacuum motor.

Based on the foregoing summary, a number of benefits of the present invention are readily seen. A cleaning machine is provided that has a removable tank that can be separated from remaining parts of the machine without the need to disconnect external hoses. The removable tank is supported on the cleaning tank and the bottom wall of the recovery tank covers the opening into the cleaning tank. Sealing members are provided that insure a tight seal to prevent unwanted fluid leakage, while still permitting ready attachment/detachment of the recovery tank. A reduced number of parts are provided for the recovery tank and the cleaning tank, including fluid passageways. In that regard, the conduits for establishing a vacuum and carrying recovered liquid are formed within the chamber of the recovery tank so that an integral, one-piece unit is provided.

Additional advantages of the present invention will become readily apparent from the following discussion, particularly when taken together with the accompanying drawing figures.

DETAILED DESCRIPTION

Figure 1:
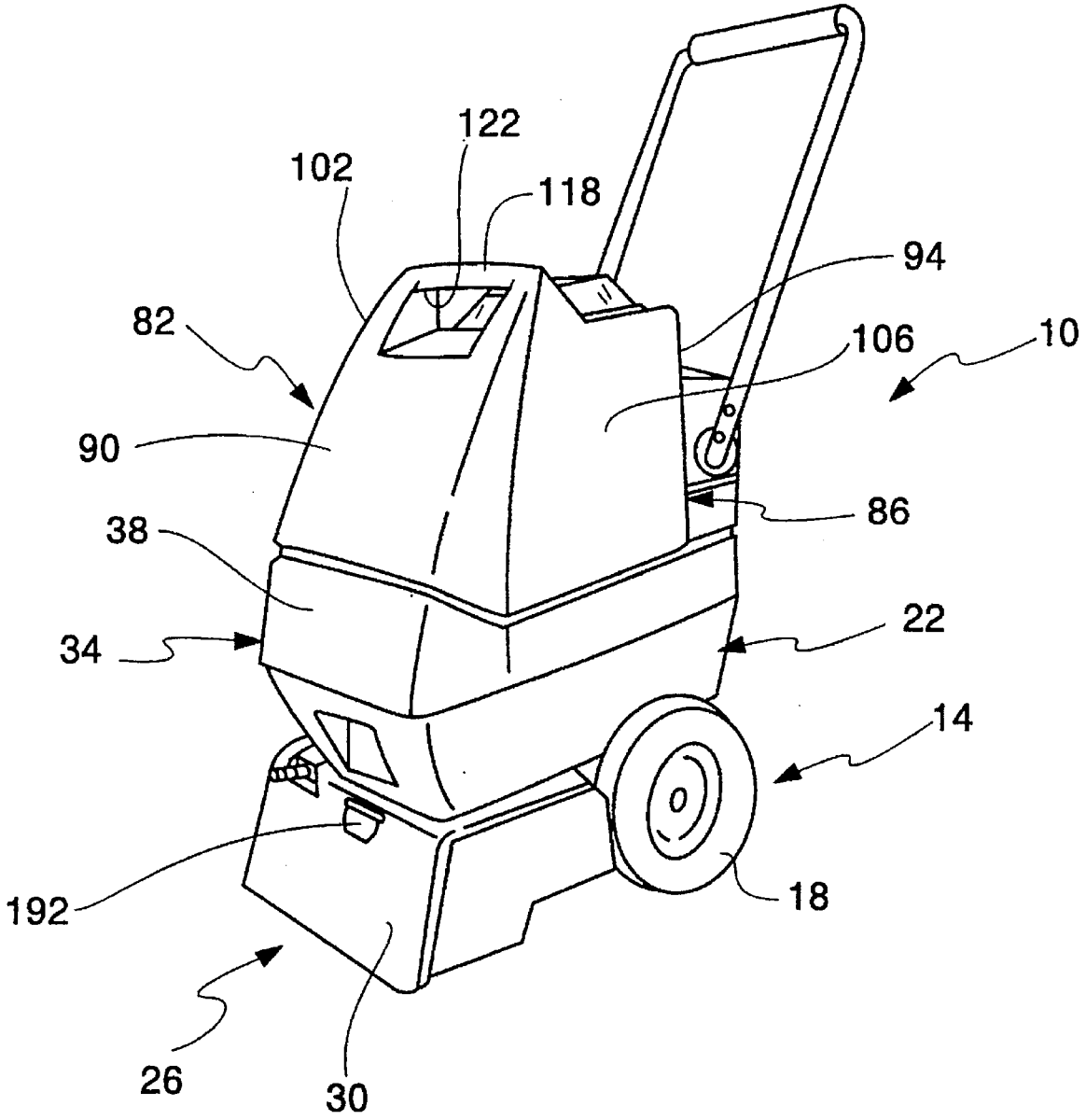
FIG. 1 is a perspective view of the cleaning machine of the present invention.
Figure 2:
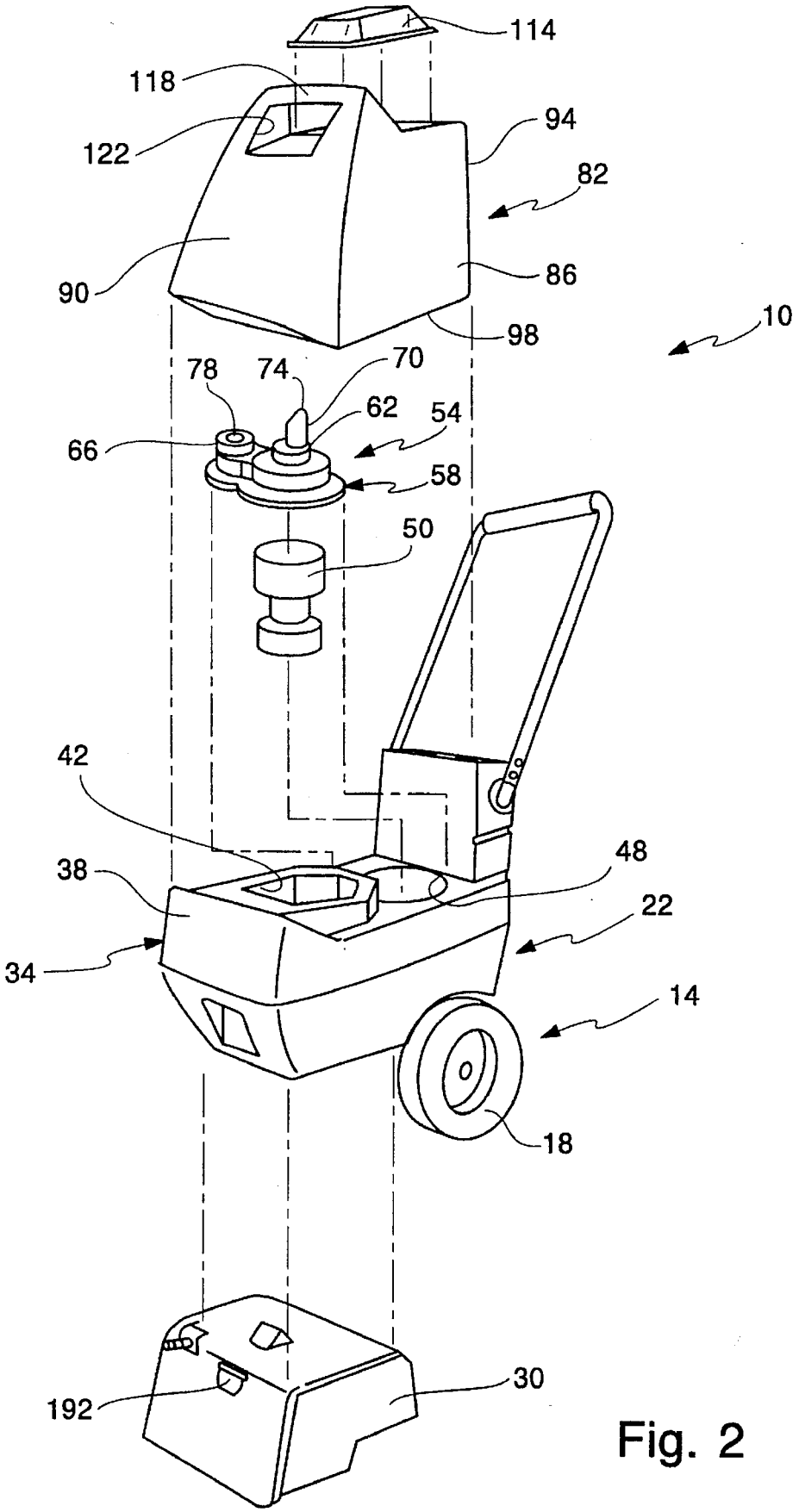
FIG. 2 is an exploded view illustrating separated major parts of the cleaning machine, including the recovery tank removed from the cleaning tank.
Figure 4:
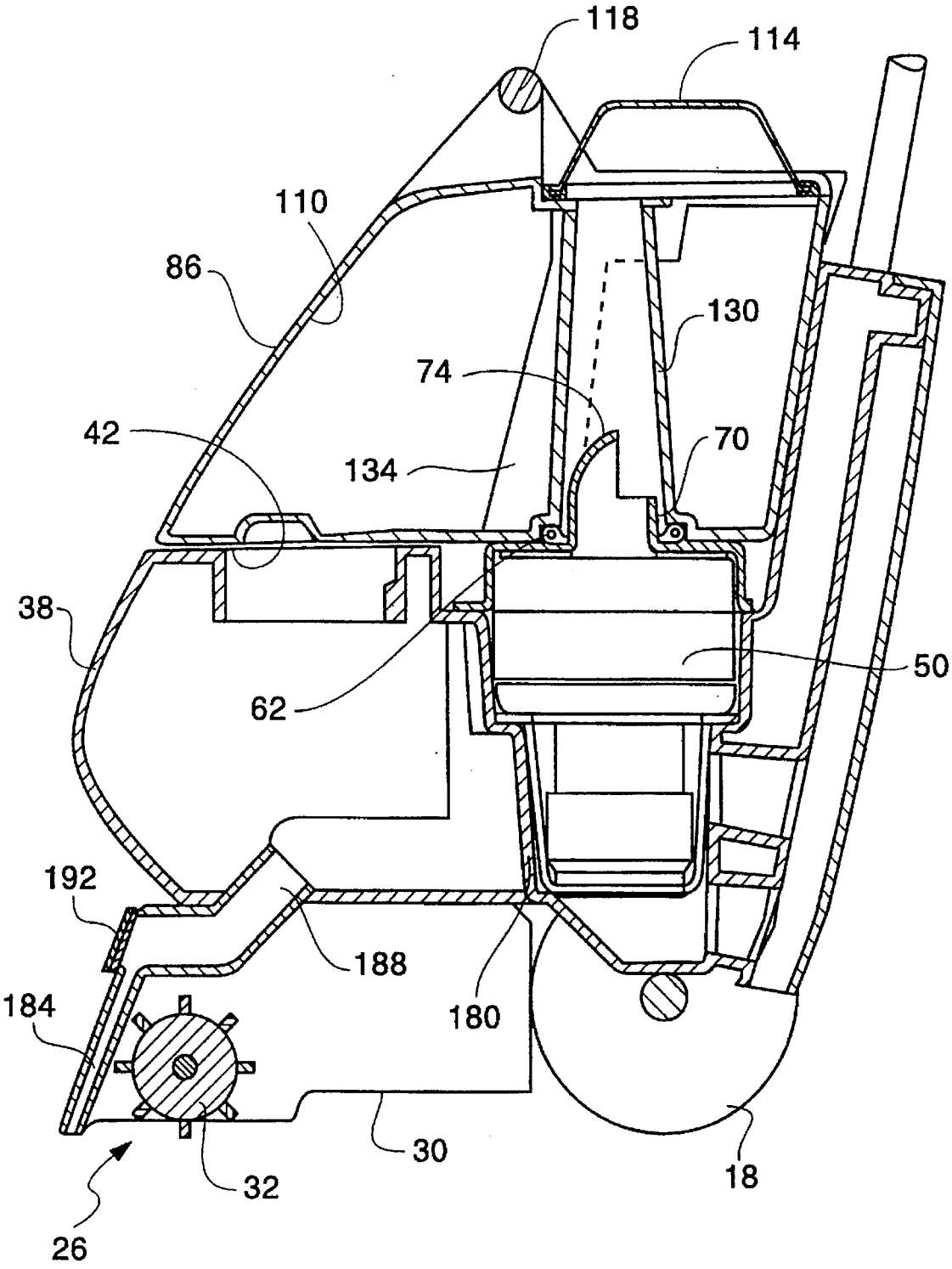
FIG. 4 is a longitudinal cross-sectional view of the cleaning machine, including an illustration of the vacuum motor, vacuum member and vacuum conduit.

In accordance with the present invention, a cleaning machine 10 is provided for cleaning floor or other surfaces. With primary reference to FIGS. 1 and 2, the cleaning machine 10 includes a number of assemblies. A support assembly 14 is provided at the base of the cleaning machine 10 and includes one or more wheels 18, with the wheels 18 being operatively joined to a frame 22 that extends upwardly from the support assembly 14. A cleaning assembly 26 is provided forward of the wheels 18 and preferably includes a shroud 30 that encloses a cleaning element, such as a cleaning brush 32, as seen in FIG. 4.

The frame 22 has a cleaning tank or container assembly 34 that includes a cleaning tank or receptacle 38 formed with an opening 42 for receiving cleaning fluid that can be applied to the floor being cleaned using one or more spray nozzles (not shown). The frame 22 also has a cavity 48 formed therein for receiving a vacuum motor 50, which is useful in creating a vacuum for causing recovered fluid to be drawn into the cleaning machine 10, as will be explained in more detail later. The cleaning machine 10 also includes an intermediate connector assembly 54 for location on top of the cavity 48. The intermediate connector assembly 54 has a base member 58 and a pair of sealing members 62, 66. The vacuum sealing member 62 encircles a vacuum member 70 having a cap 74 and the recovery sealing ring 66 encircles a recovery tube 78. Each of the sealing members 62, 66 provides a desired sealing arrangement in which a substantially liquid tight seal is provided in connection with the recovery of debris and liquid from the floor surface being cleaned.

In that regard, a recovery tank assembly 82 is positioned over the intermediate connector assembly 54 and is supported by the frame 22. The recovery tank assembly 82 includes a recovery tank 86 having a front wall 90, a back wall 94, a bottom surface 98 and first and second side walls 102, 106. These walls form or define a chamber 110, as seen in FIG. 4, for housing liquid including debris that is recovered from the floor being cleaned. The cleaning tank assembly 82 also has a lid 114 that is disposed on top of the recovery tank 86 and is preferably transparent to permit viewing by the operator or user. A gripping member 118 is provided forward of the lid 114 and an open area 122 is formed in the recovery tank 86 to enable the operator of the cleaning machine 10 to be able to readily grasp the gripping member 118 for use in removing and attaching the recovery tank 86 to the rest of the cleaning machine 10.

Figure 3:
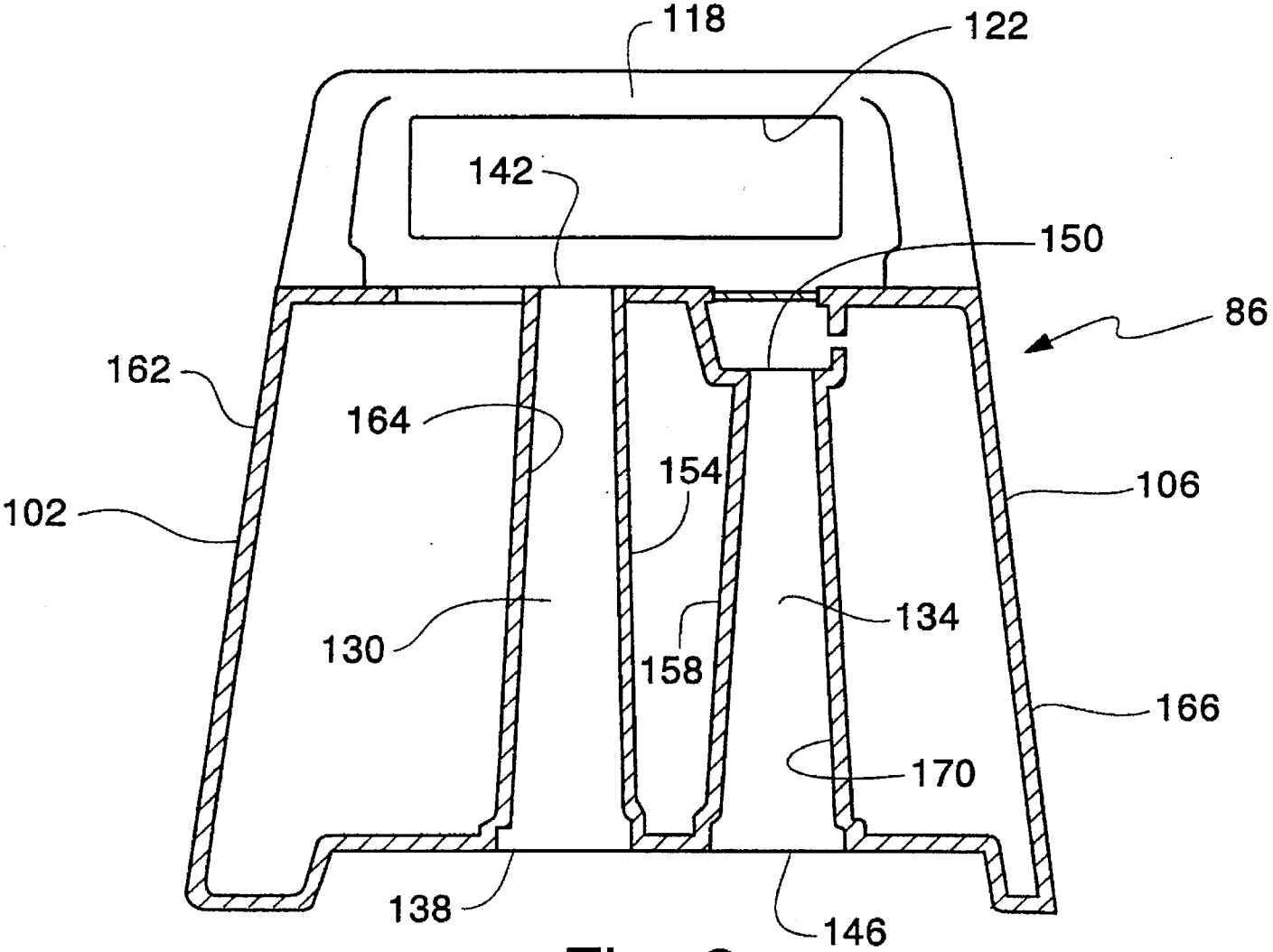
FIG. 3 is a cross-sectional view of the recovery tank illustrating the recovery inlet and the vacuum conduit.

With reference to FIG. 3, the removable recovery tank 86 is preferably molded and has a vacuum conduit 130 and a recovery inlet 134 formed as integral parts thereof. Each of the vacuum conduit 130 and the recovery inlet 134 is positioned within the chamber 110 and spaced from the front wall 90, back wall 94 and first and second side walls 102, 106. The vacuum conduit 130 has a first end 138 for receiving portions of the vacuum member 70, as seen in FIG. 4. The second or free end 142 of the vacuum conduit 130 is open to and in communication with the chamber 110 for use in creating a vacuum or area of negative pressure therein, which is useful in drawing liquid containing debris into the chamber 110. Similarly, the recovery inlet 134 has a first end 146 that is flared to permit desired communication with portions of the recovery tube 78. The second end 150 of the recovery inlet 134 permits the escape of the liquid containing debris from the recovery inlet 134 into the chamber 110. As seen in FIG. 3, the second or free end 150 terminates the recovery inlet 134 at a position less in length than the length of the vacuum conduit 130 to ensure that liquid does not pass into the vacuum conduit 130. The second end 150 is preferably positioned to permit viewing by the operator through the transparent lid 114.

With respect to the location of the vacuum conduit 130 and the recovery inlet 134 relative to each other and the walls of the recovery tank 86, the shortest distance between the inner surface 164 of the vacuum conduit 130 and the inner surface 170 of the recovery inlet 134 must be a certain or predetermined distance. Specifically, this distance must be equal to or greater than two times the thickness of the recovery tank wall material. In one embodiment, this predetermined distance is in the range of 0.5 to 6 inches and this predetermined distance must be at least 0.5 inch. Similarly, the spacing of the vacuum conduit 130 and the recovery inlet 134 from the walls of the recovery tank 94 must be a certain or predetermined minimum distance. With regard to the side walls 102, 106, the distance between the outer surface 162 of the first side wall 102 to the inner surface 164 of the vacuum conduit 130 must be at least equal to two times the thickness of the first side wall 102. In one embodiment, this predetermined distance is in the range of 0.5 to 5 inches and must be at least 0.5 inch. Likewise, the distance from the outer surface 166 of the second side wall 106 to the inner surface 170 of the recovery inlet 134 must be at least equal to two times the thickness of the recovery tank wall material. In one embodiment, this distance is in the range of 0.5 to 9.5 inches and is at least 0.5 inch.

Figure 5:
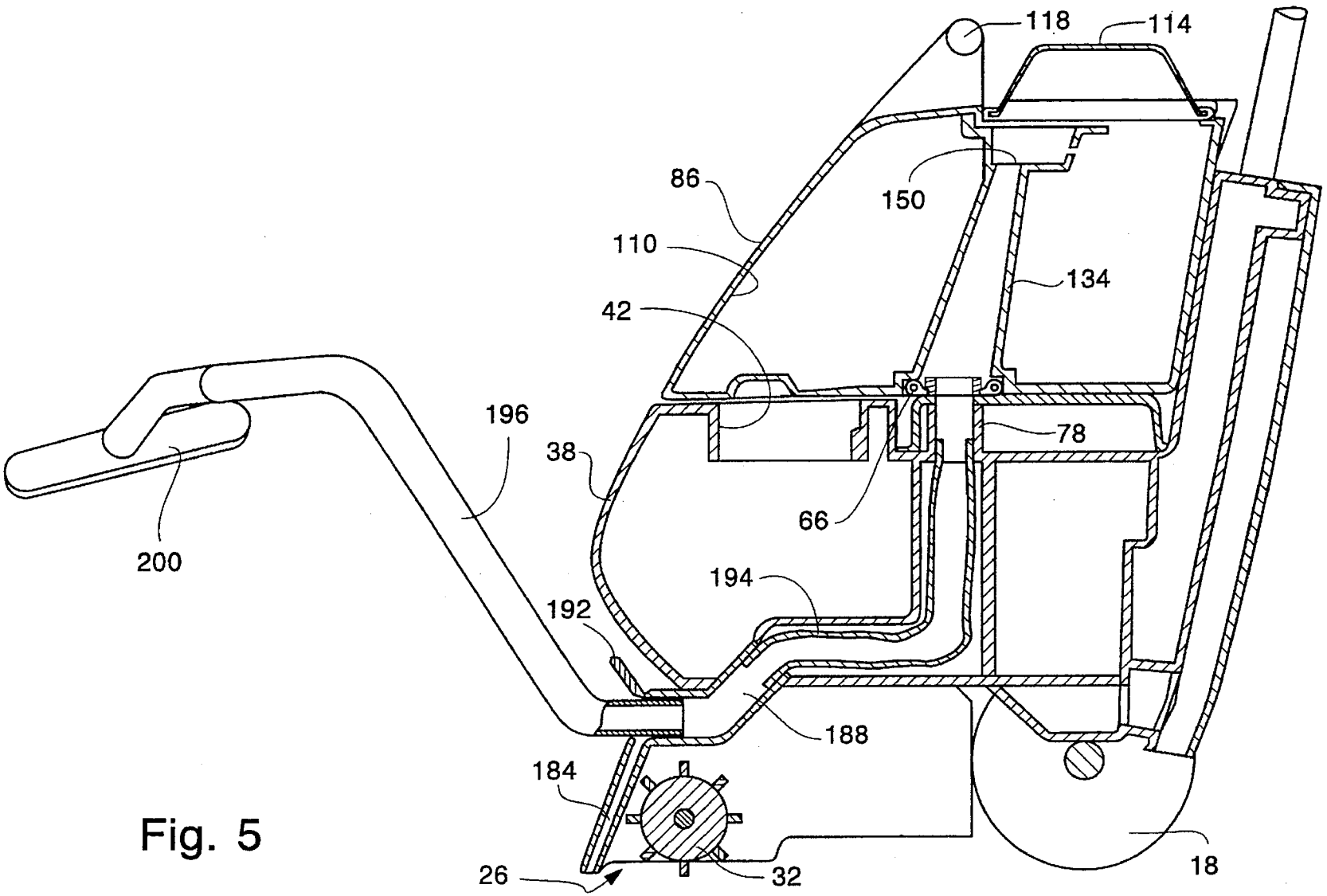
FIG. 5 is a longitudinal cross-sectional view of the cleaning machine, including an illustration of the recovery tube joined to the recovery inlet, which has a free end that communicates with the chamber of the recovery tank.

With reference to FIGS. 4 and 5, the connection and support of the recovery tank 86 relative to the vacuum conduit 130 and the recovery inlet 134 is next described. As seen in FIG. 4, when the recovery tank 86 is joined to remaining parts of the cleaning machine 10, the vacuum conduit 130 is located outwardly of portions of the vacuum member 70. The vacuum sealing member 62 is sufficiently flexible so that the weight of the recovery tank 86 by itself compresses the vacuum sealing member 62 to provide a desired fluid tight seal at this juncture. When the vacuum motor 50 is powered on and operating, negative pressure is created within the vacuum conduit 130, as well as in the chamber 110 and the recovery inlet 134. This vacuum enables the liquid containing debris to be drawn into this area of negative pressure. As can be appreciated, in the absence of a fluid tight seal, insufficient vacuum would be present in the vacuum conduit 130 due to fluid leakage at the juncture of the vacuum conduit 130 and the vacuum member 70. As can also be understood, as the recovery tank 86 fills with the liquid, the greater weight due to the liquid contributes to further compressing of the vacuum sealing member 62 and enhances the fluid tight seal at this juncture.

Referring to FIG. 5, portions of the recovery tube 78 are positioned within the recovery inlet 134. In doing this, bottom portions of the recovery inlet 134 compress the recovery sealing member 66 due to the weight of the recovery tank 86 to provide a liquid tight seal at this juncture. The recovery sealing member 66 has sufficient flexibility to achieve the desired compression while contributing to a stable support of the recovery tank 86 when it is joined to remaining parts of the cleaning machine 10.

As also seen in FIGS. 4 and 5, the recovery tank 86 also covers the opening 42 in the cleaning tank 38 and this opening 42 is exposed when the recovery tank 86 is removed from the cleaning machine 10. FIG. 4 also illustrates that the vacuum motor 50 is contained in a fluid tight casing 180. The casing 180 defines the cavity 48 of a predetermined size and shape for receiving the vacuum motor 50. The casing insures that no liquid from the cleaning tank 38 is able to penetrate therepast and reach the vacuum motor 50.

In using the cleaning machine 10, two embodiments of operation are available. As illustrated in FIG. 4, in a first mode of operation, the cleaning assembly 26 includes an inlet channel 184 formed in the shroud 30 through which liquid and debris from the floor is carried, due to the vacuum being created, into a recovery channel 188. As seen in FIG. 5, the recovery channel 188 communicates with the recovery tube 78 for carrying the liquid into the recovery inlet 134. From there, the liquid exits the top end 150 of the recovery inlet 134 into the chamber 110. Portions of the recovery channel 188 are integrally formed within the cleaning tank 38, with the walls of the recovery channel 188 maintaining the desired separation between cleaning tank fluid and the liquid containing debris that is drawn into the inlet channel 184 and then to the recovery channel 188.

During this first mode of operation, a cover 192 is in a closed position at the juncture of the inlet channel 184 and the recovery channel 188. In the second mode of operation, the cover 192 is in an open position to permit a hose 196 having a cleaning head 200 to be inserted at this portion of the recovery channel 188, as illustrated in FIG. 5. Portions of the hose 196 act as a barrier to liquid flow from the inlet member 184 to the recovery channel 188, while providing desired fluid communication from the hose 196 to the recovery channel 188.

In each of the two modes of operation, the created vacuum causes recovered liquid to be carried through the recovery channel 188 for passage, via recovery hose 194 (shown in FIG. 5 and not in FIG. 4), to the chamber 110 of the recovery tank 86. After the recovery tank 86 is sufficiently filled with recovered liquid in the chamber 110, it can be readily removed by grasping the gripping member 118 and lifting the recovery tank 86 away from the frame 22. The recovered liquid in the recovery tank 86 can be dumped or otherwise removed therefrom. While the recovery tank 86 is removed from the cleaning machine 10, the cleaning tank 38, through its opening 42, can be filled with cleaning liquid for further cleaning operations.

The foregoing discussion of the invention has been presented for purposes of illustration and description. Further, the description is not intended to limit the invention to the form disclosed herein. Variation and modification commensurate with the above teachings, within the skill and knowledge of the relevant art, are within the scope of the present invention. The embodiment described hereinabove is further intended to explain the best mode presently known of practicing the invention and to enable others skilled in the art to utilize the invention as presented, or in other embodiments, and with the various modifications required by their particular applications or uses of the invention. It is intended that the appended claims be construed to include alternative embodiments to the extent permitted by the prior art.

What is claimed is:

1. A cleaning machine, comprising:

a cleaning assembly for cleaning a surface;

a container assembly including a receptacle for housing a cleaning solution and a cavity laterally adjacent to said receptacle;

a motor held in said cavity for creating a vacuum; and a tank assembly disposed vertically above and supported by said container assembly and including a tank removable from being supported by said container assembly so that said tank can be carried with recovered liquid in order to empty the recovered liquid, said tank being positioned over each of said receptacle and said motor in said cavity wherein said tank covers each of said receptacle and said cavity, said tank including front, back, bottom and first and second side walls that define a chamber for holding the recovered liquid, a vacuum conduit used in drawing the recovered liquid into said tank and a recovery inlet for carrying the recovered liquid into said tank and in which each of said vacuum conduit and said recovery inlet are located within said chamber of said tank.

2. A cleaning machine, as claimed in claim 1, further including:

at least one wheel and wherein said motor is disposed substantially over said one wheel so that said cavity is located between said one wheel and said tank.

3. A cleaning machine, as claimed in claim 1, wherein:

said receptacle includes an opening for receiving cleaning solution and in which said opening is completely covered by portions of said bottom wall of said tank.

4. A cleaning machine, as claimed in claim 1, wherein:

said container assembly includes a vacuum member communicating with said vacuum conduit, said vacuum member operatively connected to said motor for creating a vacuum, wherein said vacuum member extends into an interior of said vacuum conduit.

5. A cleaning machine, as claimed in claim 1, wherein:

said tank assembly includes a recovery tube disposed in an interior of said recovery inlet.

6. A cleaning machine, comprising:

a cleaning assembly for cleaning a surface;

a container assembly including a receptacle for housing a cleaning solution;

a motor for creating a vacuum;

a tank assembly disposed adjacent to and supported by said container assembly and including a tank removable from said container assembly so that said tank can be carried with recovered liquid in order to empty the recovered liquid, said tank including a chamber for holding the recovered liquid, a vacuum conduit used in drawing the recovered liquid into said tank and a recovery inlet for carrying the recovered liquid into said tank;

a vacuum member positioned adjacent to said vacuum conduit;

a recovery tube positioned adjacent to said recovery inlet;

a recovery sealing member for sealing said recovery inlet; and a vacuum sealing member for sealing said vacuum conduit;

wherein said recovery tube has a wall and said recovery sealing member has an outer periphery, said tank having a bottom in which said recovery sealing member is compressed using said bottom and in which parts of said recovery sealing member are compressed against said wall of said recovery tube to provide a desired seal using the weight of said tank and wherein said vacuum member has a wall and said vacuum sealing member has an outer periphery and with said bottom of said tank being used to compress parts of said vacuum sealing member against said wall of said vacuum member to provide a desired seal using the weight of said tank.

7. A cleaning machine, as claimed in claim 6, wherein:

a majority of said motor is disposed below said tank.

8. A cleaning machine, comprising:

a cleaning assembly for cleaning a surface;

a container assembly including a receptacle for containing a cleaning solution; and a tank assembly disposed adjacent to said container assembly and including a tank removable relative to said container assembly so that said tank can be carried away from said container assembly with recovered liquid in order to empty the recovered liquid, said tank including a chamber for holding the recovered liquid, a vacuum conduit used in drawing the recovered liquid into said tank and a recovery inlet for carrying the recovered liquid into said tank, said tank further including front, back and first and second side walls for defining said chamber and with each of said walls being free of any connection to external hoses, said vacuum conduit having an upper end and said vacuum conduit extending a greater distance vertically in said chamber than said recovery inlet, wherein recovered liquid has a flow path into said chamber that is located vertically lower in said chamber throughout said flow path than said upper end of said vacuum conduit.

9. A cleaning machine, as claimed in claim 8, wherein:

said recovery inlet has an outer wall and a lower end thereof that is located at a bottom of said chamber and in which recovered liquid completely surrounds said lower end of said outer wall of said recovery inlet.

* * * * *